US009375973B2

(12) United States Patent
Huffman

(10) Patent No.: US 9,375,973 B2
(45) Date of Patent: Jun. 28, 2016

(54) AUTOGRAPH BALL WITH BUILT IN WRITING UTENSIL

(71) Applicant: In The Ball, LLC, Evansdale, IA (US)

(72) Inventor: Andrew Lee Huffman, Waterloo, IA (US)

(73) Assignee: In The Ball, LLC, Waterloo, IA (US)

( * ) Notice: Subject to any disclaimer, the term of this patent is extended or adjusted under 35 U.S.C. 154(b) by 0 days.

(21) Appl. No.: 14/331,766

(22) Filed: Jul. 15, 2014

(65) Prior Publication Data

US 2016/0016425 A1 Jan. 21, 2016

(51) Int. Cl.

| | |
|---|---|
| ***B43K 23/00*** | (2006.01) |
| ***B43K 29/00*** | (2006.01) |
| ***A63B 43/00*** | (2006.01) |
| ***A63B 45/00*** | (2006.01) |

(52) U.S. Cl.

CPC ..... *B43K 23/001* (2013.01); *A63B 43/00* (2013.01); *A63B 45/00* (2013.01); *B43K 29/00* (2013.01)

(58) Field of Classification Search

CPC combination set(s) only.
See application file for complete search history.

(56) References Cited

U.S. PATENT DOCUMENTS

| | | | | |
|---|---|---|---|---|
| 4,533,058 | A * | 8/1985 | Uhlig | 215/216 |
| 4,798,310 | A * | 1/1989 | Kasai et al. | 221/87 |
| 6,736,429 | B1 * | 5/2004 | Steeg | 283/117 |

* cited by examiner

*Primary Examiner* — David Walczak
(74) *Attorney, Agent, or Firm* — Nyemaster Goode PC

(57) ABSTRACT

An autograph ball with built in writing utensil may include a ball having an outer skin, an inner core, and a hole through the outer skin into the inner core. A writing utensil may be removably placed within the hole of the ball. A spring and cap mechanism may be placed within the hole before placing the writing utensil within the hole. The autograph ball may further include a hatch that may cover the hole and a latch that may removably secure the hatch in place. The autograph ball may be for various sports, be of various sizes, and be made from various materials.

5 Claims, 3 Drawing Sheets

AUTOGRAPH BALL WITH BUILT IN WRITING UTENSIL

BACKGROUND OF THE INVENTION

The present invention relates to autograph signing and, more particularly, to an autograph ball with built in writing utensil.

Fans at professional sporting events want to get autographs from the players. Getting a pen and the item to be signed to an athlete can often be very difficult. In some situations, the item to be autographed has to go through multiple hands before getting to the athlete and back. In this process, the ability to sign the item may be lost for a period of time with the writing utensil lost or dropped, which may have the result of the fan not obtaining an autograph.

As can be seen, there is a need for an autograph ball with built in writing utensil.

SUMMARY OF THE INVENTION

In one aspect of the present invention, an autograph ball with built in writing utensil comprises: a ball having an outer skin, an inner core, and a hole through the outer skin into the inner core; and a writing utensil removably placed within the hole of the ball.

In another aspect of the present invention, a method for maintaining a writing utensil with an item to be autographed comprises: producing a hole within a ball, wherein the ball has an outer skin and a inner core; and placing a writing utensil within the hole of the ball, wherein the writing utensil and ball comprise an autograph ball.

These and other features, aspects and advantages of the present invention will become better understood with reference to the following drawings, description and claims.

DETAILED DESCRIPTION OF THE INVENTION

Figure 1:
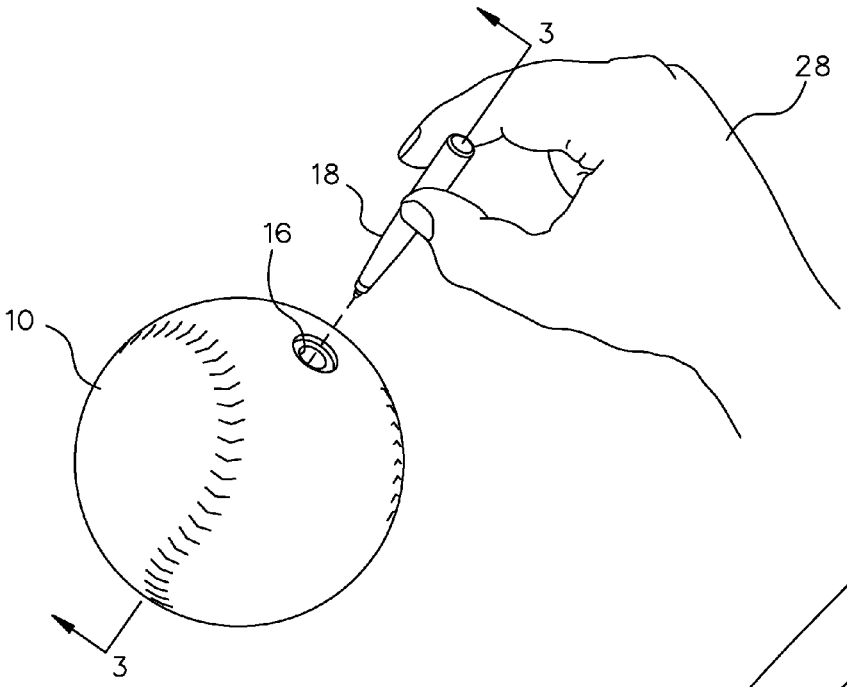
FIG. 1 is a perspective view of an exemplary embodiment of the present invention shown in use.
Figure 2:
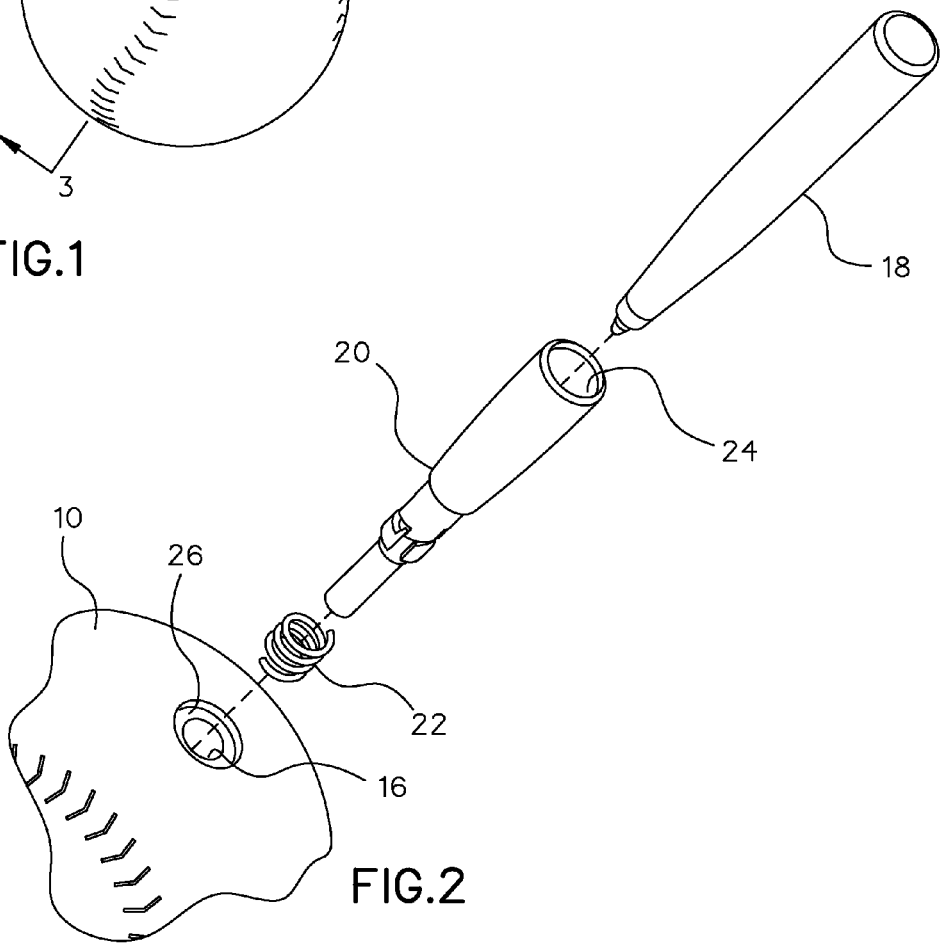
FIG. 2 is an exploded perspective view of an exemplary embodiment of the present invention.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides an autograph ball with built in writing utensil that may include a ball having an outer skin, an inner core, and a hole through the outer skin into the inner core. A writing utensil may be removably placed within the hole of the ball. A spring and cap mechanism may be placed within the hole before placing the writing utensil within the hole. The autograph ball may further include a hatch that may cover the hole and a latch that may removably secure the hatch in place. The autograph ball may be for various sports, be of various sizes, and be made from various materials.

As is illustrated in FIGS. 1 through 5, an autograph ball with a built in writing utensil may include a ball 10. The ball 10 may have a hole 16 through an outer skin 12 down to an inner core 14 of the ball 10. The hole 16 may be drilled in the ball 10. A writing utensil 18 such as a pen, a marker or the like may be removably placed within the drilled hole 16.

Figure 3:
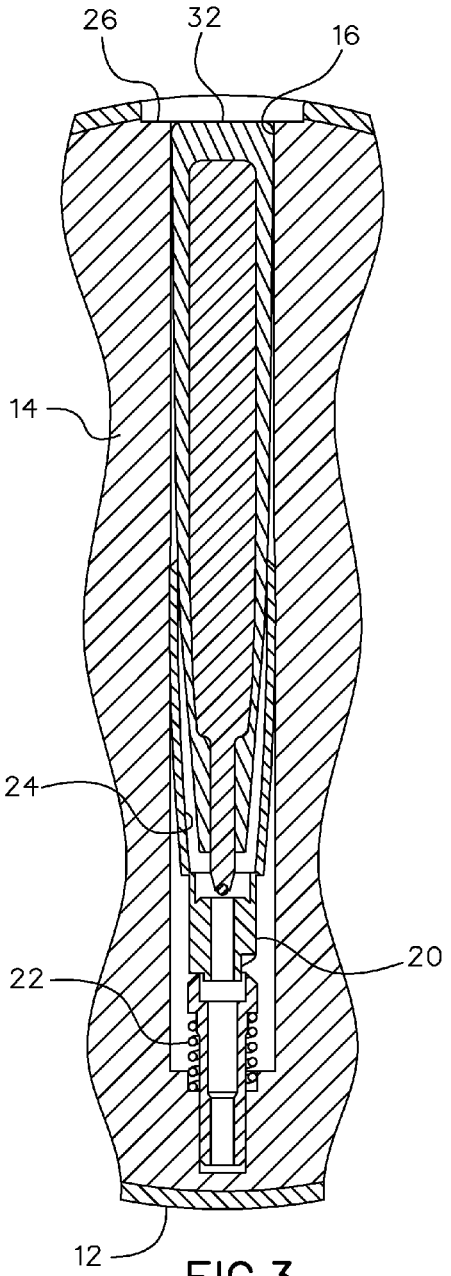
FIG. 3 is a detailed section view of an exemplary embodiment of the present invention taken along line 3-3 in FIG. 1 showing the fully inserted writing utensil.
Figure 4:
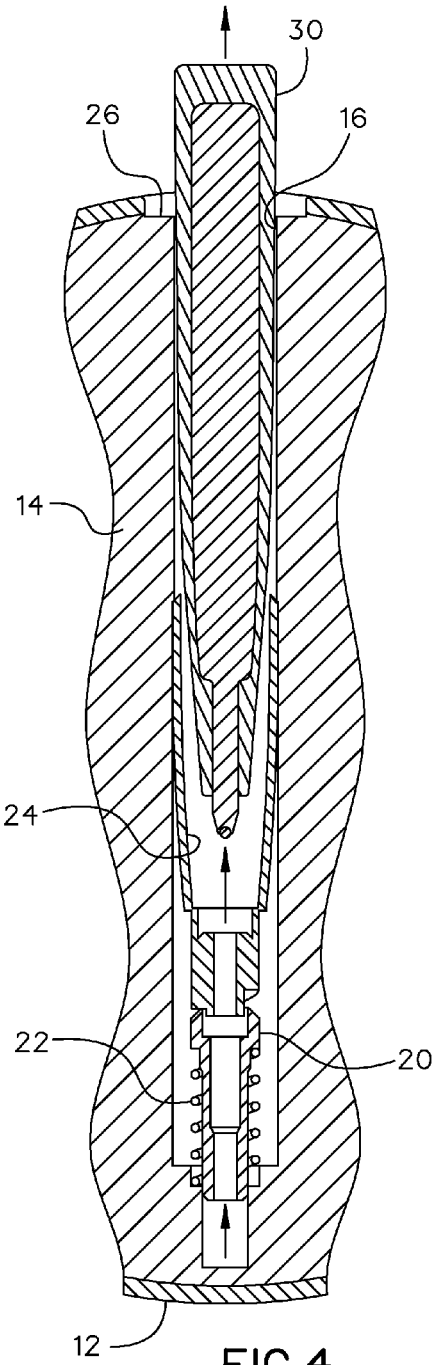
FIG. 4 is a detailed section view of an exemplary embodiment of the invention showing the partially ejected writing utensil.
Figure 5:
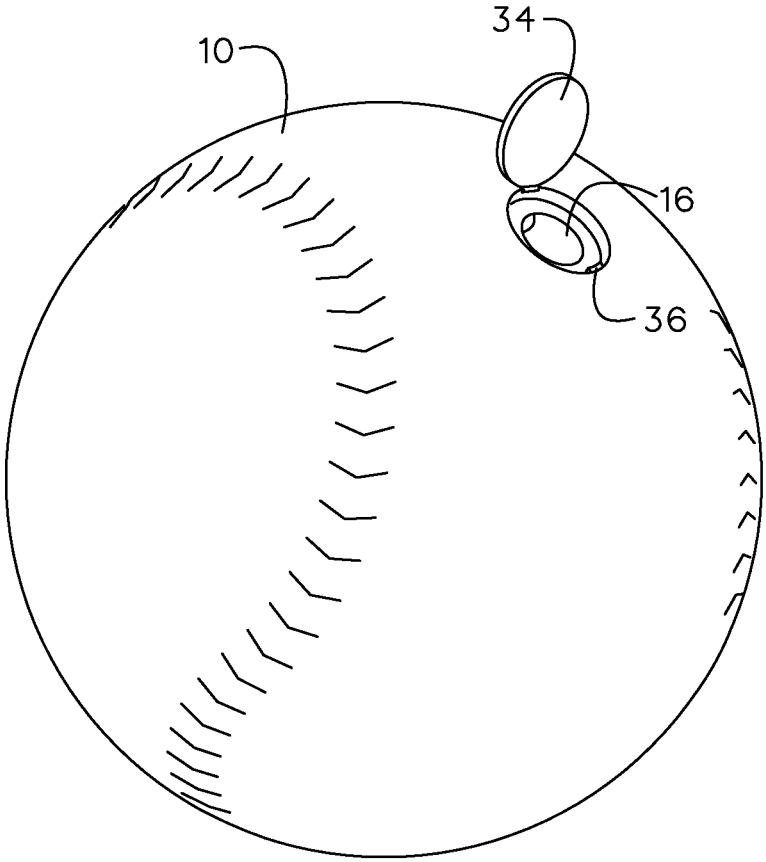
FIG. 5 is a perspective view of an alternate embodiment of the present invention.

In certain embodiments, a spring 22 may be placed within the hole 16. A cap mechanism 20 having a cap opening 24 may be placed over the spring 22. The cap mechanism 20 may retract, press fit or the like. The cap opening 24 may allow for the placement of the writing utensil 18 into the cap mechanism 20. The cap mechanism 20 may allow for the writing utensil 18 to stay within the hole 16 while not in use, and allow the writing utensil 18 to eject from the ball 10 when needed for use. The spring 22 released may allow the cap mechanism 20 to extend so that the writing utensil 18 may extend out from the ball 10. While the spring 22 may be compressed by the cap mechanism 20, the cap mechanism 20 may allow the writing utensil 18 to remain within the space of the hole 16. FIG. 3 shows the fully inserted writing utensil 32 and FIG. 4 shows the partially ejected writing utensil 30.

In certain embodiments, a hatch 34 may be removably placed over the drilled hole 16. The hatch 34 may close off the drilled hole 16, and may be able to be removably secured by a latch 36.

A method of making the invention may include the following. The hole 16 may be drilled into the ball 10. The spring 22 may be placed within the drilled hole 16, and then the cap mechanism 20 may be placed within the hole 16. A person 28 may then place the writing utensil 18 into the hole 16. In certain embodiments, the writing utensil 18 may be placed in the hole 16 with a writing point down towards the spring 22. The dilled hole 16 may have a counter bore 26 along an inner perimeter of the hole 16. In certain embodiments, a hatch 34 may be placed over the counter bore 26 section. The latch 36 may be added to the skin 12 of the ball 10 to keep the components in the ball 10 until needed. In certain embodiments, the latch 36 may be placed along the counter bore 26 of the drilled hole 16.

A method of using the invention may include the following. An athlete may receive the ball 10 from a fan. The athlete may then rotate the hatch 34 by tripping the latch 36. The writing utensil 18 may be pulled out from the hole 16. The writing utensil 18 may extend out from the hole 16 when the hatch 34 may be opened. The writing utensil 18 may be used to sign an autograph on the ball 10 and then the writing utensil 18 may be placed back into the hole 16 before returning the ball 10 to the fan. The fan may keep the autographed ball 10 or sell it for a value.

In certain embodiments, the ball 10 may be a baseball, a basketball, a football, a soccer ball, a hockey puck or the like. The ball 10 may be of actual size and material normally used for that particular sport. The ball 10 may be made from a different material such as a sponge-like material, a soft material, or the like. The ball 10 may be of various sizes.

It should be understood, of course, that the foregoing relates to exemplary embodiments of the invention and that modifications may be made without departing from the spirit and scope of the invention as set forth in the following claims.

What is claimed is:

1. An autograph ball with built in writing utensil comprising:

a ball having an outer skin, an inner core, a hole through the outer skin at an upper end and into the inner core and closed at a lower end, and a spring disposed at the lower end;

a hatch rotatably connected to the ball comprising an open state and a closed state and further comprising a latch; and a writing utensil removably placed within the hole of the ball wherein when the hatch is in the closed state, the latch is operably connected with the ball and holds the hatch in the closed state and the writing utensil remains substantially within the hole, and when the hatch in the open state, the spring urges the writing utensil out of the hole such that it can be removed by a user.

2. The autograph ball with built in writing utensil of claim 1, wherein the hole further comprises a counter bore.

3. A method for maintaining a writing utensil with an item to be autographed comprising:

providing a ball, with an outer skin and a inner core, a hole in the ball with a closed bottom end through the outer skin and into the inner core, and a spring disposed in the bottom end;

placing a writing utensil within a cap disposed within the hole of the ball, the cap being urged out of the hole by the spring;

providing a hatch with a latch;

preventing the writing utensil from being extracted from the hole by latching the hatch to the ball.

4. The method of claim 3, wherein the hatch is rotationally attached to the ball.

5. The method of claim 3, further comprising extracting the writing utensil from the hole by unlatching the hatch.

* * * * *